US011767991B1

(12) United States Patent
Marshall et al.

(10) Patent No.: US 11,767,991 B1
(45) Date of Patent: Sep. 26, 2023

(54) AC OUTDOOR EQUIPMENT COVER

(71) Applicants: Calleen K. Marshall, Grand Saline, TX (US); Joseph P. Gorman, Grand Saline, TX (US)

(72) Inventors: Calleen K. Marshall, Grand Saline, TX (US); Joseph P. Gorman, Grand Saline, TX (US)

( * ) Notice: Subject to any disclaimer, the term of this patent is extended or adjusted under 35 U.S.C. 154(b) by 0 days.

(21) Appl. No.: 18/137,310

(22) Filed: Apr. 20, 2023

(51) Int. Cl.
*F24F 1/58* (2011.01)

(52) U.S. Cl.
CPC ..... *F24F 1/58* (2013.01)

(58) Field of Classification Search
CPC ..... F24F 1/58; F24F 1/56; F24F 1/06; F24F 2221/52
See application file for complete search history.

(56) References Cited

U.S. PATENT DOCUMENTS 2,901,989 A * 9/1959 Mondi ..... F24F 13/20 62/262
2,914,075 A 11/1959 Wells et al.
2,941,380 A * 6/1960 Garred ..... F24F 13/00 62/262
3,002,236 A 10/1961 Humphner
3,328,929 A 7/1967 Mullins
4,019,556 A 4/1977 Selger
4,730,423 A * 3/1988 Hughes ..... E04H 15/003 52/27
4,953,328 A 9/1990 Sewell et al.
6,158,175 A * 12/2000 Carter ..... F24F 1/58 52/79.5
6,595,017 B1 * 7/2003 Teahan ..... F24F 1/50 62/DIG. 13
7,836,653 B1 * 11/2010 Herrington ..... F24F 1/58 49/51
8,357,031 B2 1/2013 Dinicolas
8,414,367 B1 4/2013 Virag et al.
2006/0059935 A1 * 3/2006 Braswell ..... F24F 1/58 62/507
2015/0338125 A1 * 11/2015 Bowen ..... F24F 13/20 150/165

* cited by examiner

*Primary Examiner* — Joseph F Trpisovsky
(74) *Attorney, Agent, or Firm* — CRAMER PATENT & DESIGN, PLLC; Aaron R. Cramer

(57) ABSTRACT

An AC outdoor equipment cover is a protective shade cover for window air conditioners. The device is made from a lightweight durable material, that is both portable and collapsible for shipping and subsequent storage. The device slips around and over the upper part of a window mount air conditioner by forming a sloped cover from the outer distal edge of the external air conditioner housing and the window or building structure above the unit. It is envisioned that this cover will be at an approximate angle of thirty degrees (30°).

20 Claims, 10 Drawing Sheets

AC OUTDOOR EQUIPMENT COVER

RELATED APPLICATIONS

None.

FIELD OF THE INVENTION

The present invention relates generally to an equipment cover and more specifically to an equipment cover for an AC outdoor unit.

BACKGROUND OF THE INVENTION

Mankind's quality of life in recent times has been vastly improved with the introduction of air conditioning. In fact, there are those who say that air conditioning is a more important invention than that of the computer. However, with all of its enjoyed benefits, the practice of producing a negative heat delta is fraught with disadvantages and inefficiencies. Most of these inefficiencies are based upon the fact that excess heat still must be transferred to surrounding air.

On a window mount style air conditioner, this is accomplished by an outdoor condensing unit in which a heat exchanger and forced fan air are used to transfer heat. While such a method works, it is not very efficient due to the high temperature of the outside air. Such inefficiencies then translate into higher operating costs. Accordingly, there exists a need by which the functionality and efficiency of window mounted air conditioning units can be easily increased. The development of the AC outdoor equipment cover fulfills this need in a manner that is cost-effective and efficient.

SUMMARY OF THE INVENTION

To achieve the above and other objectives, the present invention provides for an AC outdoor equipment cover which has an inclined cover shielding a plurality of air conditioning equipment from direct exposure from sunlight, a first orthogonal cover shielding the air conditioning equipment from direct exposure to sunlight, a second orthogonal cover shielding the air conditioning equipment from direct exposure to sunlight, and a third orthogonal cover shielding the air conditioning equipment from direct exposure to sunlight, the inclined cover is hingedly coupled to the third orthogonal cover at one or more locations along the bottom half of the inclined cover.

One or more braces may support a top end of the inclined cover. The one or more braces may be an armature with an inverted U-shape. A bottom of the one or more braces may be hingedly or slidably coupled to the first orthogonal cover and to the second orthogonal cover. Air may circulate around the air conditioning equipment by moving through a space between the inclined cover and the first orthogonal cover and a space between the inclined cover and the second orthogonal cover. Air may circulate through the folded layers to carry away heat caused by sunlight striking the outer layer before heat reaches the inner layer and is radiated towards the air conditioning equipment. The first orthogonal cover may be a vertically-oriented rectangular panel. The first orthogonal cover may be located on a first side of the air conditioning equipment.

The first orthogonal cover may be positioned to create a first air gap between the first orthogonal cover and the first side of the air conditioning equipment. The second orthogonal cover may be positioned to create a second air gap between the second orthogonal cover and the first side of the air conditioning equipment. The first orthogonal cover may include a first plurality of vent slots that permit airflow through the first orthogonal cover.

The second orthogonal cover may be a vertically-oriented rectangular panel. The second orthogonal cover may be located on a second side of the air conditioning equipment. The second orthogonal cover may include a second plurality of vent slots that permit airflow through the second orthogonal cover. The first orthogonal cover, the second orthogonal cover, and the inclined cover may be collapsed for storage by folding relative to the third orthogonal cover.

The first orthogonal cover, the second orthogonal cover, the third orthogonal cover, or any combination thereof may be slotted to enable air circulation around the air conditioning equipment. The one or more corrugated panels may include an outer layer, one or more folded layers, and an inner layer. The outer layer may be made of aluminum or copper. The one or more folded layers may be made of plastic or compacted insulation board and are accordion folded. The inner layer may be made from mold-resistant material, treated mold-resistant material, or both.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
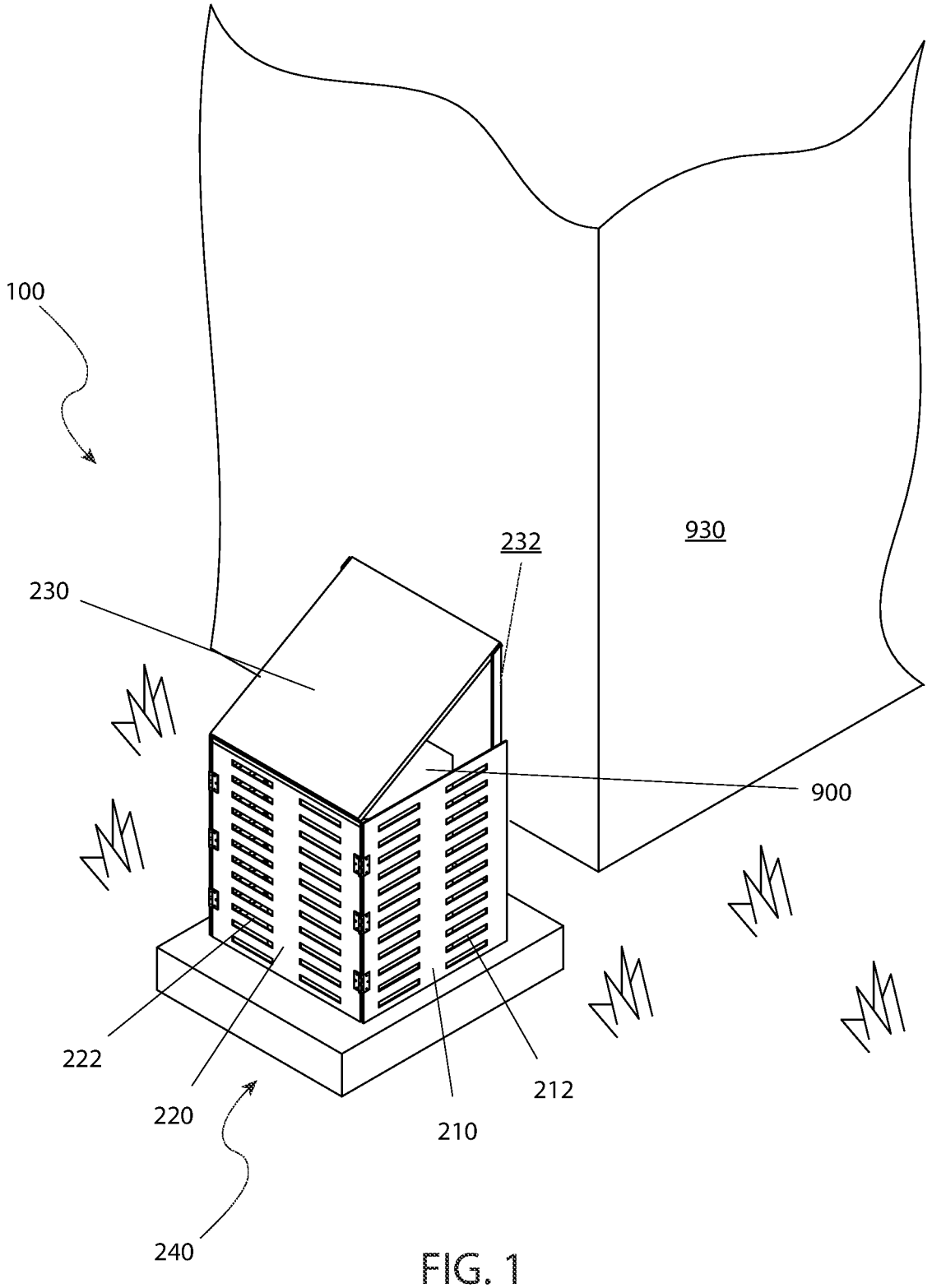
FIG. 1 is a top isometric in-use view of an AC outdoor equipment cover, according to an embodiment of the present invention, illustrating a preferred embodiment.
Figure 2:
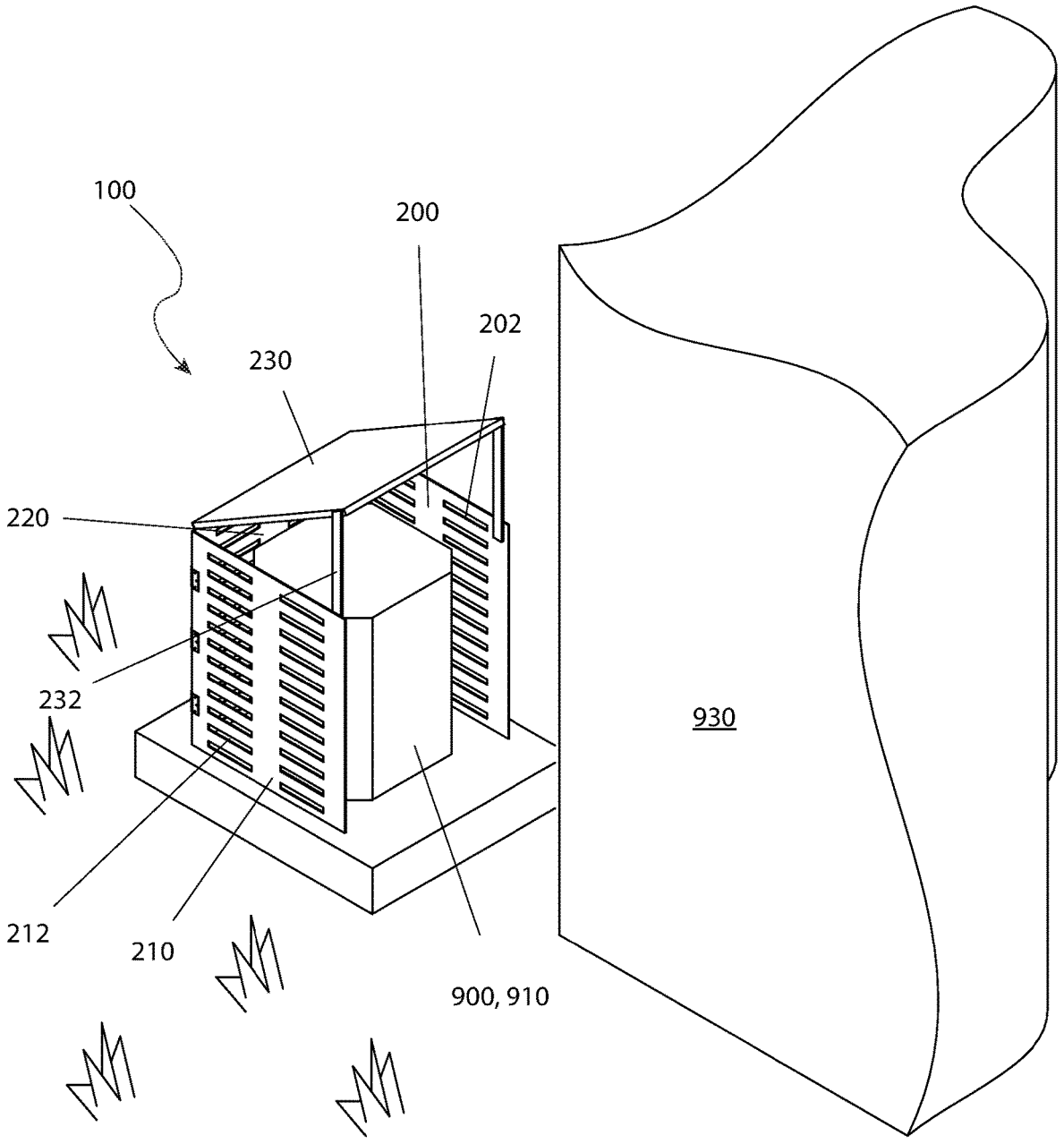
FIG. 2 is a top reverse isometric in-use view of an AC outdoor equipment cover, according to an embodiment of the present invention.
Figure 3:
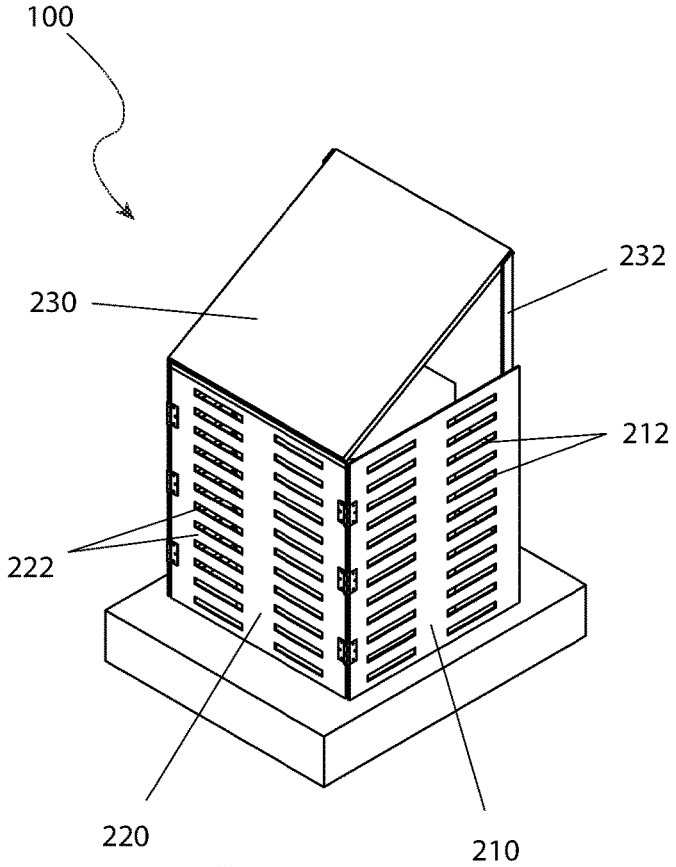
FIG. 3 is a top isometric view of an AC outdoor equipment cover, according to an embodiment of the present invention.
Figure 4:
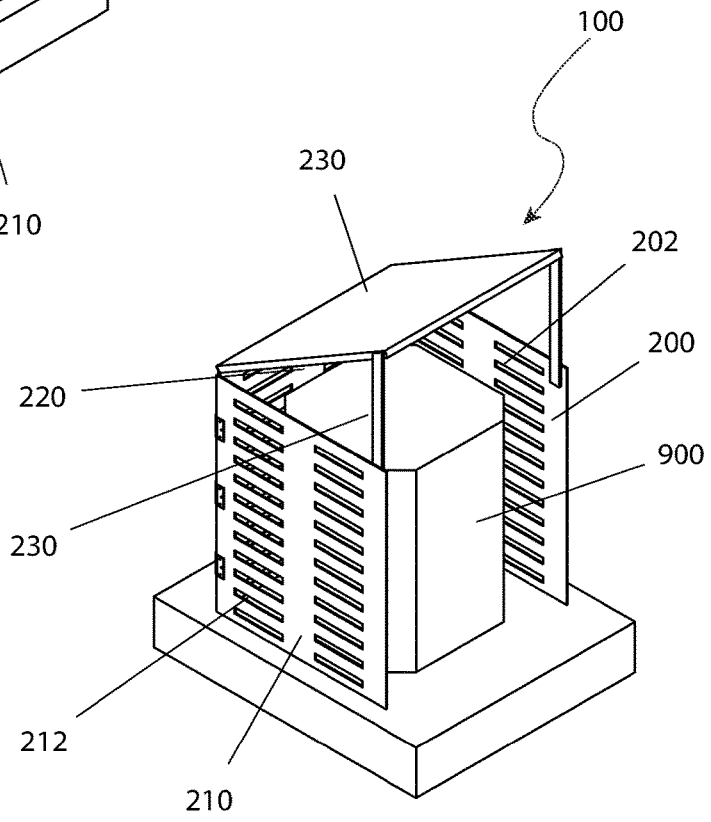
FIG. 4 is a top reverse isometric view of an AC outdoor equipment cover, according to an embodiment of the present invention.
Figure 5:
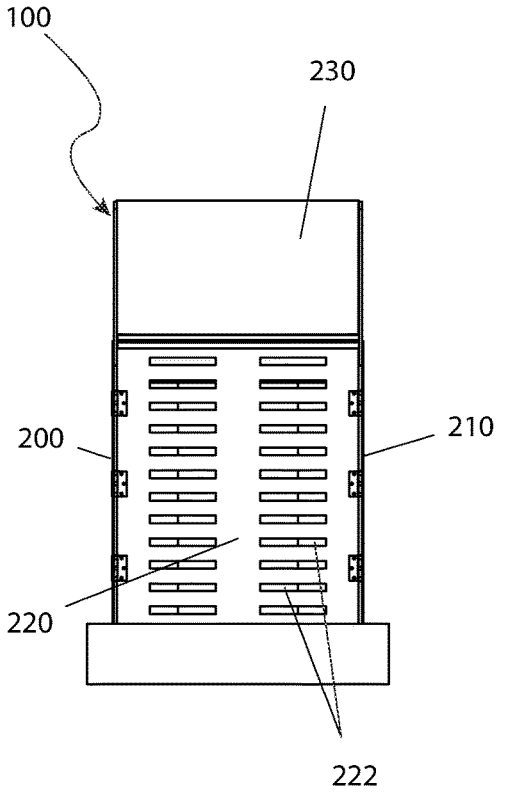
FIG. 5 is a front view of an AC outdoor equipment cover, according to an embodiment of the present invention.
Figure 6:
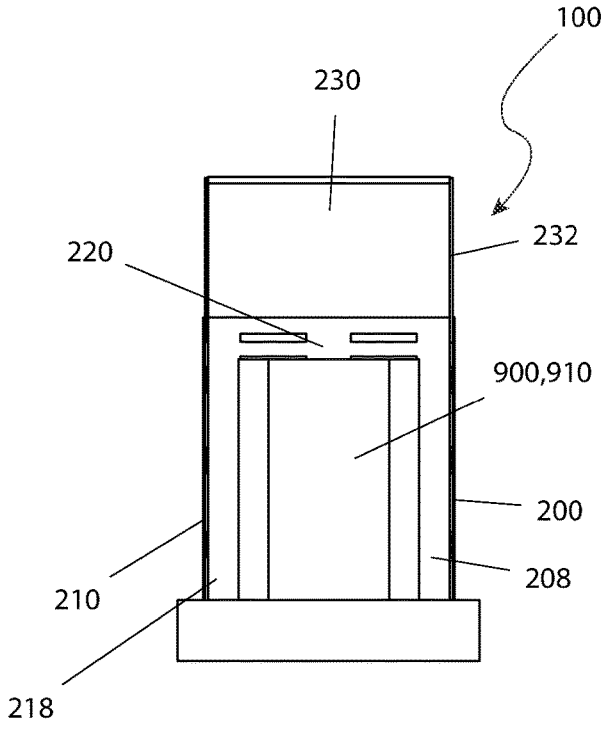
FIG. 6 is a rear view of an AC outdoor equipment cover, according to an embodiment of the present invention.
Figure 7:
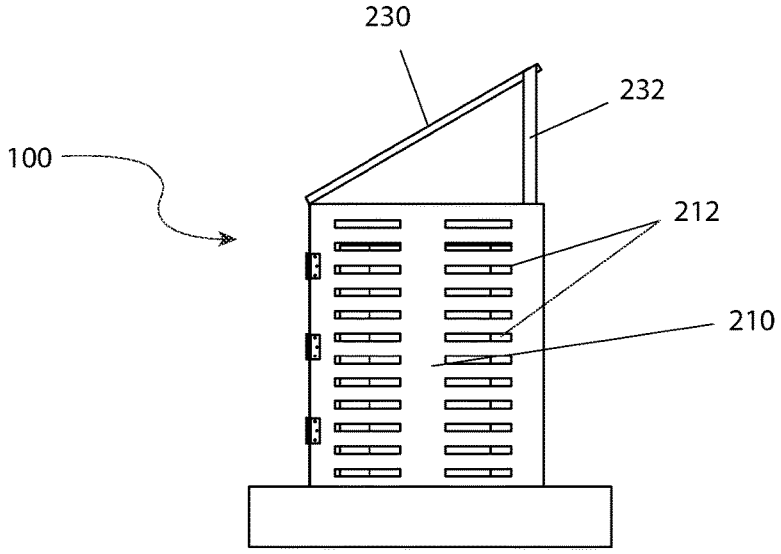
FIG. 7 is a side view of an AC outdoor equipment cover, according to an embodiment of the present invention.
Figure 8:
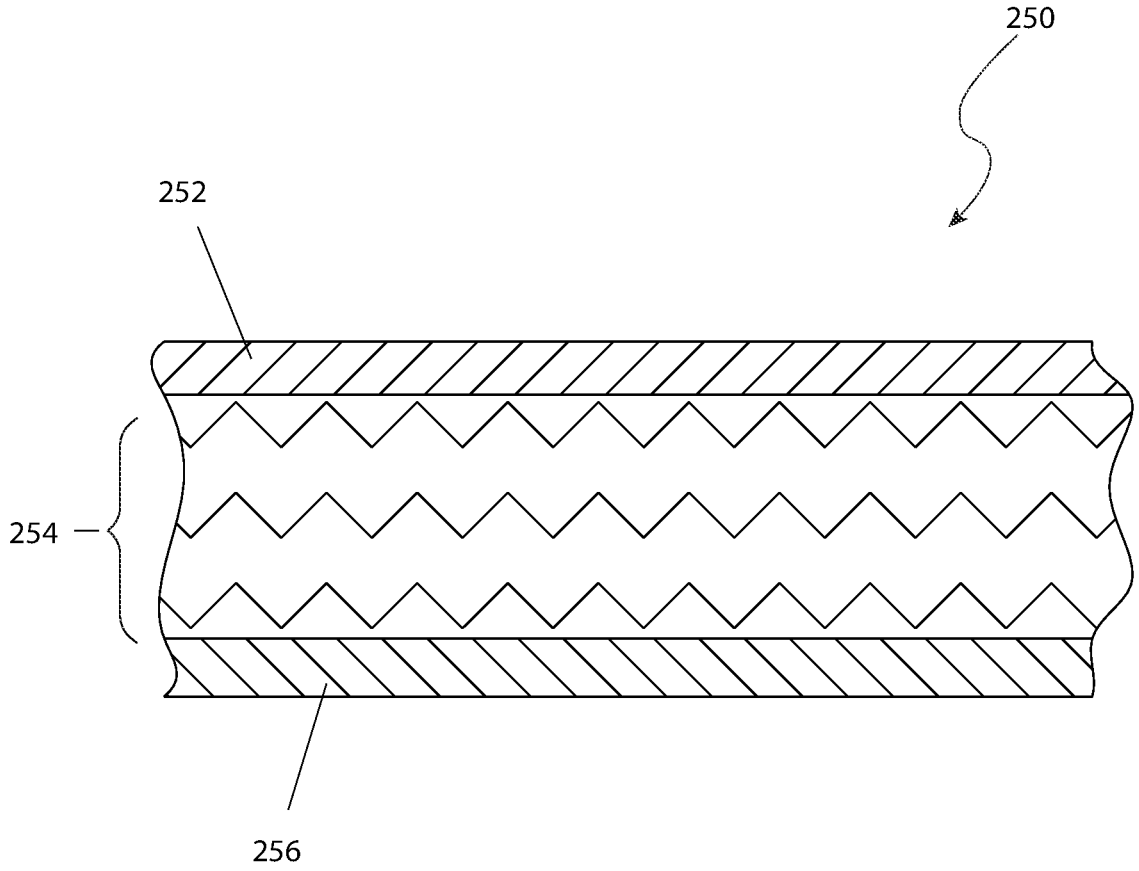
FIG. 8 is a rear view of a corrugated panel, according to an embodiment of the present invention.
Figure 9:
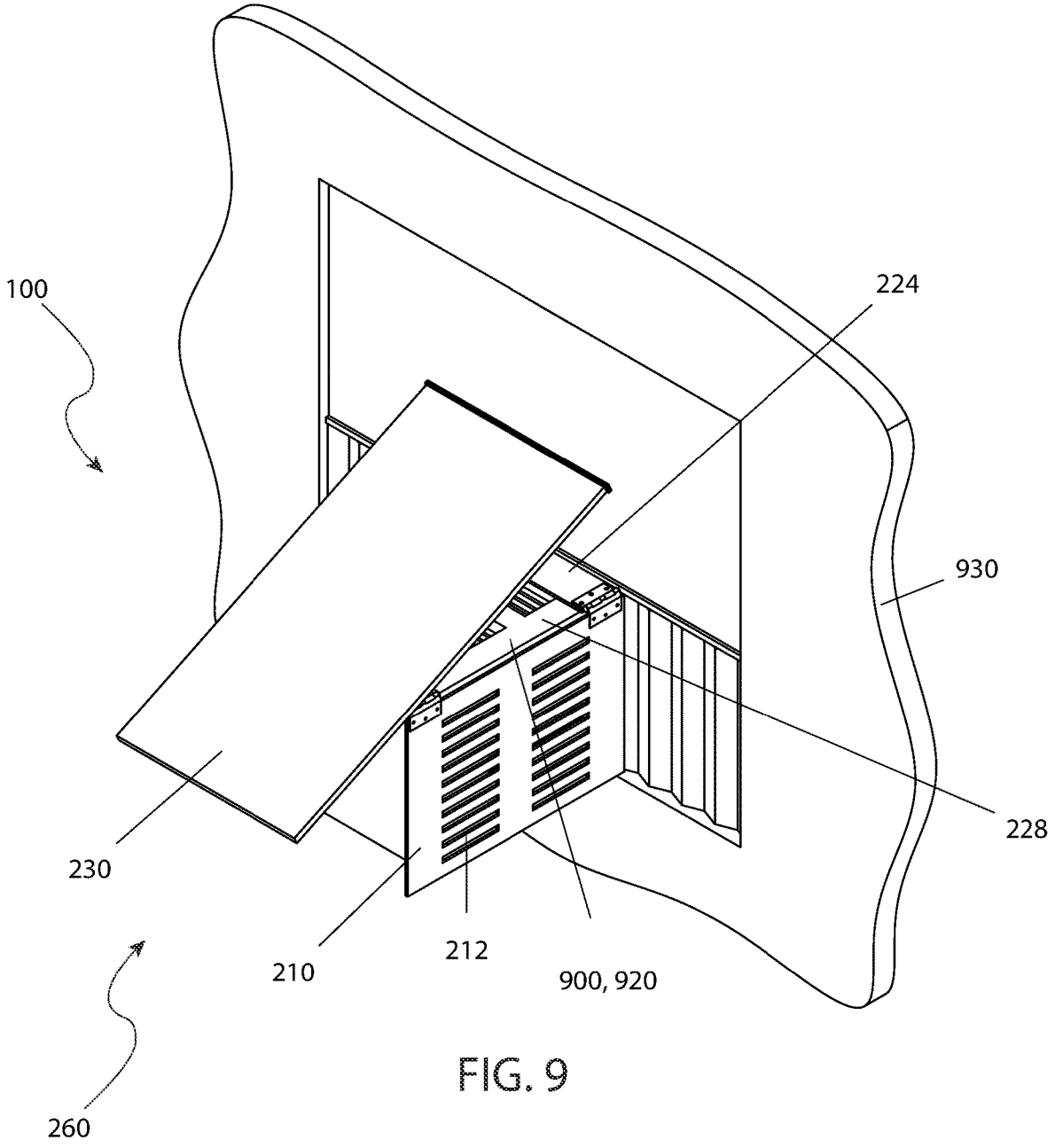
FIG. 9 is a top isometric in-use view of an AC outdoor equipment cover, according to an embodiment of the present invention, illustrating an alternative embodiment.
Figure 10:
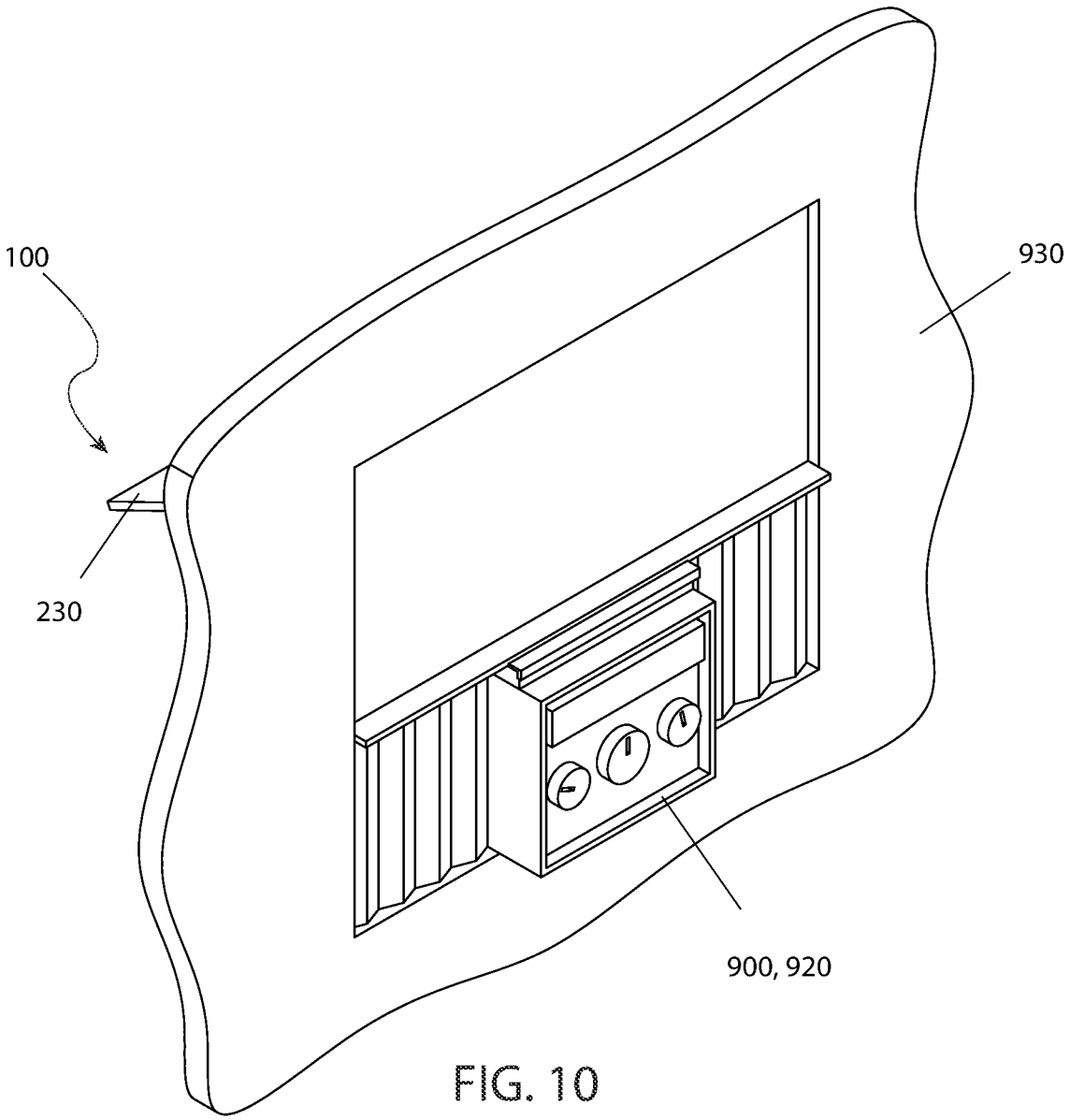
FIG. 10 is a top reverse isometric in-use view of an AC outdoor equipment cover, according to an embodiment of the present invention.
Figure 11:
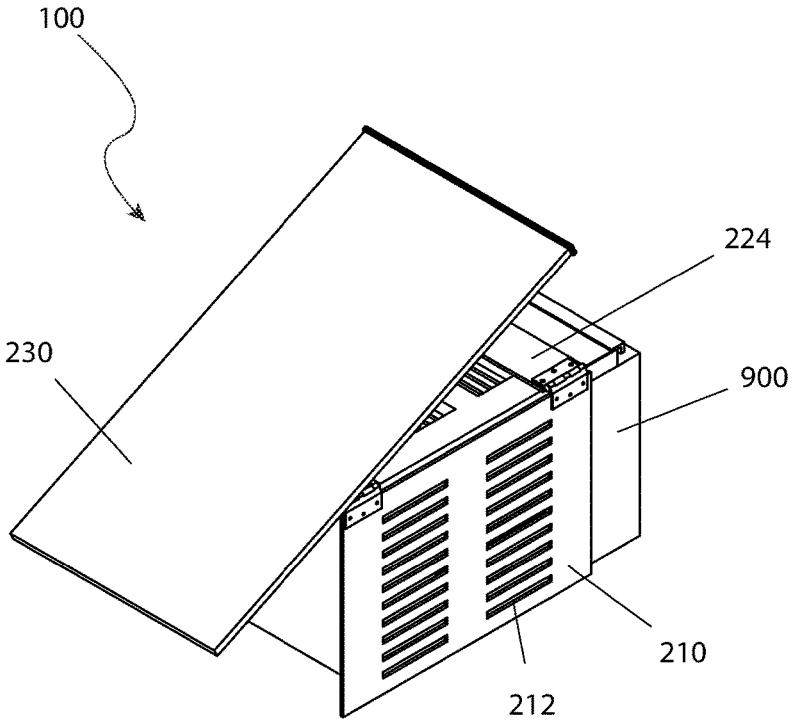
FIG. 11 is a top isometric view of an AC outdoor equipment cover, according to an embodiment of the present invention.
Figure 12:
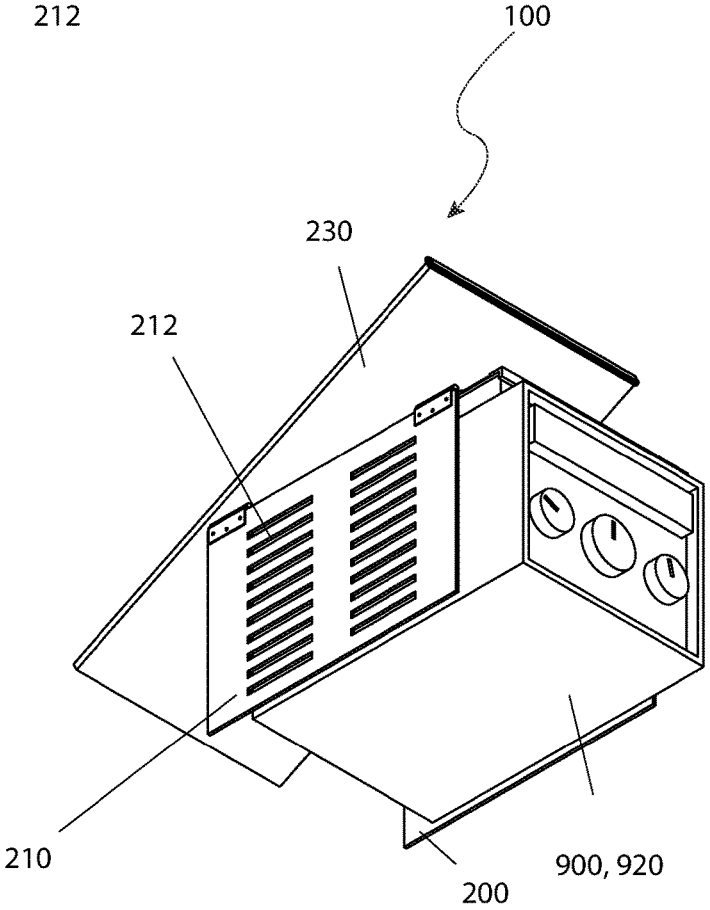
FIG. 12 is a bottom reverse isometric view of an AC outdoor equipment cover, according to an embodiment of the present invention.
Figure 13:
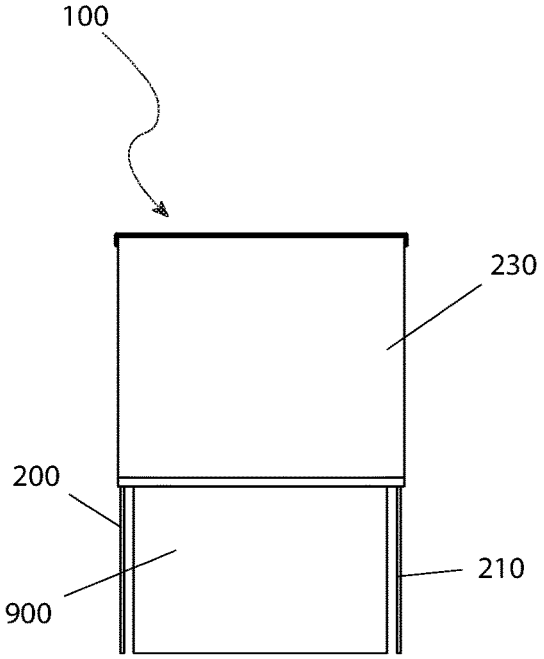
FIG. 13 is a front view of an AC outdoor equipment cover, according to an embodiment of the present invention.
Figure 14:
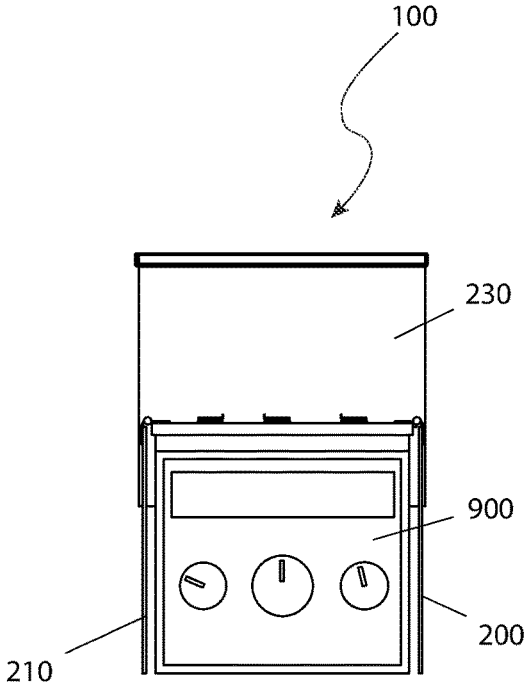
FIG. 14 is a rear view of an AC outdoor equipment cover, according to an embodiment of the present invention.
Figure 15:
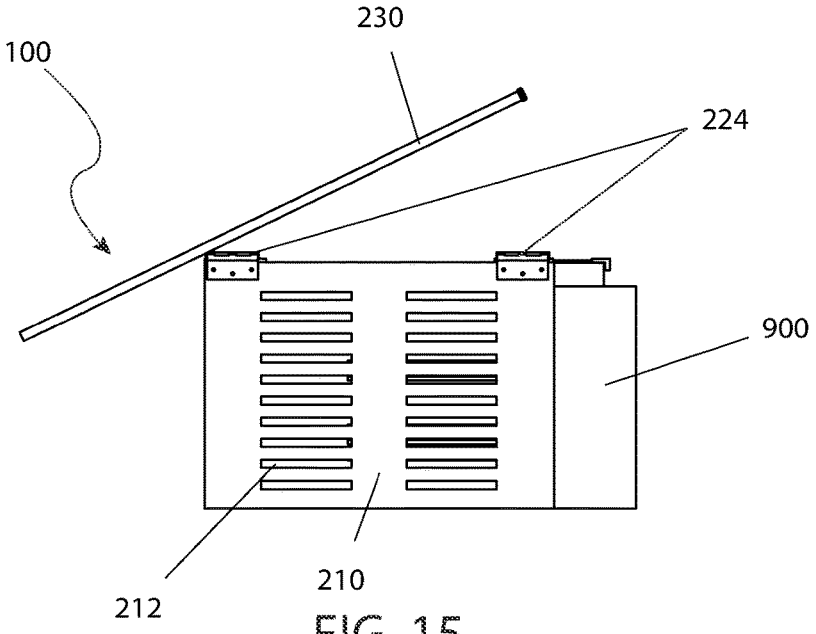
FIG. 15 is a side view of an AC outdoor equipment cover, according to an embodiment of the present invention.
Figure 16:
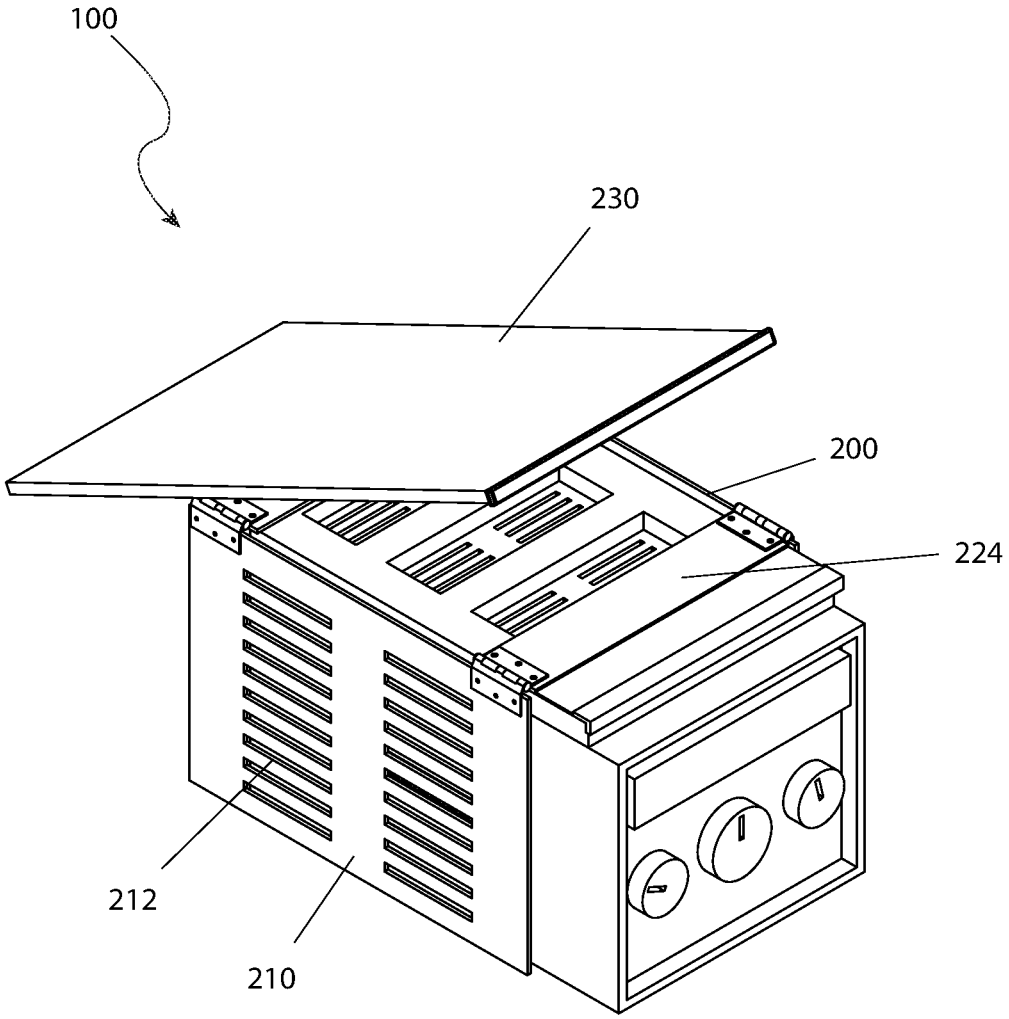
FIG. 16 is a top reverse isometric in-use view of an AC outdoor equipment cover, according to an embodiment of the present invention.

100 AC outdoor equipment cover
200 first orthogonal cover
202 first vent slot
208 first air gap
210 second orthogonal cover
212 second vent slot
218 second air gap
220 third orthogonal cover
222 third vent slot
224 cross panel
228 third air gap
230 inclined cover
232 brace
240 preferred embodiment
250 corrugated panel
252 outer layer
254 folded layer
256 inner layer
260 alternative embodiment
900 air conditioning equipment
910 outdoor unit
920 window air conditioner
930 building

DESCRIPTION OF THE INVENTION

The present invention is directed to an AC outdoor equipment cover (herein described as the "invention") 100. The AC outdoor equipment cover 100 (hereinafter invention) may comprise a first orthogonal cover 200, a second orthogonal cover 210, a third orthogonal cover 220, and an inclined cover 230 that may shield air conditioning equipment 900 from direct exposure to the sun. The first orthogonal cover 200, the second orthogonal cover 210, the third orthogonal cover 220, or any combination thereof may be slotted to enable air circulation around the air conditioning equipment 900. The invention 100 may be easily installed on and detached from the air conditioning equipment 900. The first orthogonal cover 200, the second orthogonal cover 210, and the third orthogonal cover 220 may be oriented orthogonally to the ground. Specifically, the first orthogonal cover 200, the second orthogonal cover 210, and the third orthogonal cover 220 may be oriented vertically or horizontally with respect to the ground. The inclined cover 230 may be oriented non-orthogonally with respect to the ground.

Throughout this document, the clear side may refer to the side of the air conditioning equipment 900 that is farthest away from a building 930.

The first orthogonal cover 200 may be a vertically-oriented rectangular panel. The first orthogonal cover 200 may be located on the left side of the air conditioning equipment 900. The first orthogonal cover 200 may be positioned to create a first air gap 208 between the first orthogonal cover 200 and the left side of the air conditioning equipment 900. The first orthogonal cover 200 may comprise a first plurality of vent slots 202 that may permit airflow through the first orthogonal cover 200.

The second orthogonal cover 210 may be a vertically-oriented rectangular panel. The second orthogonal cover 210 may be located on the right side of the air conditioning equipment 900. The second orthogonal cover 210 may be positioned to create a second air gap 218 between the second orthogonal cover 210 and the right side of the air conditioning equipment 900. The second orthogonal cover 210 may comprise a second plurality of vent slots 212 that may permit airflow through the second orthogonal cover 210.

The inclined cover 230 may be a rectangular panel that may be positioned above the air conditioning equipment 900 in order to shade the air conditioning equipment 900. The inclined cover 230 may be tilted at an oblique angle with respect to the ground. Specifically, the low end of the inclined cover 230 may be positioned away from the building 930 and the high end of the inclined cover 230 may be positioned closer to the building 930.

The inclined cover 230 may be hingedly coupled to the third orthogonal cover 220 at one (1) or more locations along the bottom half of the inclined cover 230. One (1) or more braces 232 may support the top end of the inclined cover 230. In some embodiments, the braces 232 may be an armature in the shape of an inverted U. The bottom of the braces 232 may be hingedly or slidably coupled to the first orthogonal cover 200 and to the second orthogonal cover 210. The braces 232 may be repositionable to vary the angle of the inclined cover 230. The braces 232 may be secured to hold a specific angle of the inclined cover 230. Air may circulate around the air conditioning equipment 900 by moving through the space between the inclined cover 230 and the first orthogonal cover 200 and the space between the inclined cover 230 and the second orthogonal cover 210.

The first orthogonal cover 200, the second orthogonal cover 210, the third orthogonal cover 220, the inclined cover 230, or any combination thereof may be corrugated panels 250 for strength and enhanced heat dissipation. The corrugated panel 250 may comprise an outer layer 252, one (1) or more folded layers 254, and an inner layer 256. As non-limiting examples, the outer layer 252 may be made of aluminum or copper. As non-limiting examples, the folded layers 254 may be made of plastic or compacted insulation board. As a non-limiting example, the folded layers 254 may be accordion folded. As non-limiting examples, the inner layer 256 may be made from mold-resistant material, may be treated to be mold-resistant, or both. Air may flow through the folded layers 254 to carry away heat caused by the sun striking the outer layer 252 before the heat reaches the inner layer 256 and is radiated towards the air conditioning equipment 900. The invention 100 may collapse for storage by folding the first orthogonal cover 200, the second orthogonal cover 210, and the inclined cover 230 relative to the third orthogonal cover 220 such that the invention 100 is flattened.

In a preferred embodiment 240, the invention 100 may be configured to shield an outdoor unit 910 of a whole-house HVAC system. The third orthogonal cover 220 may be a vertically-oriented rectangular panel that may hingedly be coupled to the first orthogonal cover 200 and the second orthogonal cover 210 on the clear side of the air conditioning equipment 900. The third orthogonal cover 220 may be positioned to create a third air gap 228 between the third orthogonal cover 220 and the clear side of the air conditioning equipment 900. The third orthogonal cover 220 may comprise a third plurality of vent slots 222 that may permit airflow through the third orthogonal cover 220. The invention 100 may rest upon the ground. In this context, the ground may be taken to include an equipment pad that the air conditioning equipment 900 may rest upon.

In the preferred embodiment 240, the inclined cover 230 may be slope upwards from the top of the third orthogonal cover 220 to the top of the braces 232 such that the inclined cover 230 may shade the top of the air conditioning equipment 900.

In an alternative embodiment 260, the invention 100 may be configured to shield a window air conditioner 920. The third orthogonal cover 220 may be horizontally-oriented and located on top of the air conditioning equipment 900. The third orthogonal cover 220 may comprise a plurality of cross panels 224 that may be coupled to the top of the first orthogonal cover 200 on one (1) side of the cross panels 224 and to the top of the second orthogonal cover 210 on the opposite side of the cross panels 224. The cross panels 224 may provide one (1) or more air gaps to permit air to pass through the third orthogonal cover 220. In some embodiments, the inclined cover 230 may be hingedly coupled to the cross panels 224 on the clear side and the top of the inclined cover 230 may rest against the building 930 or window. The plurality of cross panels 224 may support the invention 100 such that the first orthogonal cover 200 and the second orthogonal cover 210 hang down alongside the air conditioning equipment 900. The invention 100 may rest upon the air conditioning equipment 900.

In the alternative embodiment 260, the inclined cover 230 may extend farther away from the building 930 than the end of the window air conditioner 920 such that the low end of the inclined cover 230 may shield the clear side of the air conditioning equipment 900.

In use, the invention 100 may be installed on air conditioning equipment 900 to shield the air conditioning equipment 900 from direct exposure to the sun. In a preferred embodiment 240, the invention 100 may be placed on the ground to encompass the air conditioning equipment 900 such that the clear side of the air conditioning equipment 900, the left side and right side of the air conditioning equipment 900, and the top of the air conditioning equipment 900 are shaded. In an alternative embodiment 260, the invention 100 may be placed on top of the air conditioning equipment 900 such that the clear side of the air conditioning equipment 900, the left side and right side of the air conditioning equipment 900, and the top of the air conditioning equipment 900 are shaded.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An AC outdoor equipment cover, comprising:

an inclined cover shielding a plurality of air conditioning equipment from direct exposure from sunlight;

a first orthogonal cover shielding the air conditioning equipment from direct exposure to sunlight;

a second orthogonal cover shielding the air conditioning equipment from direct exposure to sunlight; and a third orthogonal cover shielding the air conditioning equipment from direct exposure to sunlight, the inclined cover is hingedly coupled to the third orthogonal cover at one or more locations along the bottom half of the inclined cover.

2. The AC outdoor equipment cover, according to claim 1, wherein one or more braces supports a top end of the inclined cover.

3. The AC outdoor equipment cover, according to claim 2, wherein the one or more braces are an armature with an inverted U-shape.

4. The AC outdoor equipment cover, according to claim 3, wherein a bottom of the one or more braces are hingedly or slidably coupled to the first orthogonal cover and to the second orthogonal cover.

5. The AC outdoor equipment cover, according to claim 1, wherein air circulates around the air conditioning equipment by moving through a space between the inclined cover and the first orthogonal cover and a space between the inclined cover and the second orthogonal cover.

6. The AC outdoor equipment cover, according to claim 1, wherein air circulates through the folded layers to carry away heat caused by sunlight striking the outer layer before heat reaches the inner layer and is radiated towards the air conditioning equipment.

7. The AC outdoor equipment cover, according to claim 1, wherein the first orthogonal cover is a vertically oriented rectangular panel.

8. The AC outdoor equipment cover, according to claim 1, wherein the first orthogonal cover is located on a first side of the air conditioning equipment.

9. The AC outdoor equipment cover, according to claim 8, wherein the first orthogonal cover is positioned to create a first air gap between the first orthogonal cover and the first side of the air conditioning equipment.

10. The AC outdoor equipment cover, according to claim 8, wherein the second orthogonal cover is positioned to create a second air gap between the second orthogonal cover and the first side of the air conditioning equipment.

11. The AC outdoor equipment cover, according to claim 1, wherein the first orthogonal cover includes a first plurality of vent slots that permit airflow through the first orthogonal cover.

12. The AC outdoor equipment cover, according to claim 1, wherein the second orthogonal cover is a vertically-oriented rectangular panel.

13. The AC outdoor equipment cover, according to claim 1, wherein the second orthogonal cover is located on a second side of the air conditioning equipment.

14. The AC outdoor equipment cover, according to claim 1, wherein the second orthogonal cover includes a second plurality of vent slots that permit airflow through the second orthogonal cover.

15. The AC outdoor equipment cover, according to claim 1, wherein the first orthogonal cover, the second orthogonal cover, and the inclined cover are collapsed for storage by folding relative to the third orthogonal cover.

16. The AC outdoor equipment cover, according to claim 1, wherein the first orthogonal cover, the second orthogonal cover, the third orthogonal cover, or any combination thereof is slotted to enable air circulation around the air conditioning equipment.

17. The AC outdoor equipment cover, according to claim 1, wherein the one or more corrugated panels include an outer layer, one or more folded layers, and an inner layer.

18. The AC outdoor equipment cover, according to claim 17, wherein the outer layer is made of aluminum or copper.

19. The AC outdoor equipment cover, according to claim 17, wherein the one or more folded layers are made of plastic or compacted insulation board and are accordion folded.

20. The AC outdoor equipment cover, according to claim 17, wherein the inner layer is made from mold-resistant material, treated mold-resistant material, or both.

* * * * *